US005606219A

United States Patent [19]

Tobita et al.

[11] Patent Number: 5,606,219

[45] Date of Patent: Feb. 25, 1997

[54] CATHODE FOR ELECTRONIC FLASH TUBE

[75] Inventors: Tsutomu Tobita; Tatsuya Isomura; Hideaki Takeuchi, all of Kanagawa, Japan

[73] Assignee: Fuji Photo Film Co., Ltd., Kanagawa, Japan

[21] Appl. No.: 541,541

[22] Filed: Oct. 10, 1995

Related U.S. Application Data

[63] Continuation of Ser. No. 172,745, Dec. 27, 1993, abandoned.

[30] Foreign Application Priority Data

Dec. 25, 1992 [JP] Japan ..... 4-346070
Feb. 3, 1993 [JP] Japan ..... 5-016344

[51] Int. Cl.[6] ..... H01J 61/04

[52] U.S. Cl. ..... 313/632; 313/630

[58] Field of Search ..... 313/630, 682

[56] References Cited

U.S. PATENT DOCUMENTS

| | | | |
|---|---|---|---|
| 4,275,330 | 6/1981 | Cho et al. | 313/630 |
| 4,315,187 | 2/1982 | Chow | 313/558 |
| 4,318,024 | 3/1982 | Rech et al. | 313/558 |
| 4,415,835 | 11/1983 | Mishra et al. | 313/627 |
| 4,739,221 | 4/1988 | Achter et al. | 313/632 |
| 4,853,596 | 8/1989 | Lausch | 313/632 |
| 4,999,478 | 3/1991 | Bushey et al. | 219/137 WM |
| 5,095,191 | 3/1992 | Bushey et al. | 219/137 WM |

OTHER PUBLICATIONS

Hodgman et al. Handbook Of Chemistry And Physics 43rd Edition p. 2231.

*Primary Examiner*—Kevin A. Kriess
*Assistant Examiner*—Lawrence O. Richardson
*Attorney, Agent, or Firm*—Young & Thompson

[57] ABSTRACT

A xenon electronic flash tube has a transparent glass tube body. Xe gas is enclosed in the tube body. An anode is projected inside the tube body. A cathode, inside the tube body, is projected toward the anode, and includes base metal material and a Cs compound having a characteristic of emitting electrons, such as $Cs_2Ta_2O_6$.

15 Claims, 3 Drawing Sheets

CATHODE FOR ELECTRONIC FLASH TUBE

This is a continuation of application Ser. No. 08/172,745, filed Dec. 27, 1993, now abandoned.

BACKGROUND OF THE INVENTION

1. Field of the Invention

The present invention relates to a cathode for an electronic flash tube. More particularly, the present invention relates to an improvement of a cathode for an electronic flash tube capable of being manufactured with ease and with constantly high quality.

2. Description of the Prior Art

A camera incorporates an electronic flash device, which is constituted of a flash tube, a main capacitor, and a trigger capacitor. In the flash tube is enclosed xenon gas (Xe). In the inactive state of the flash tube, the resistance between an anode and a cathode of the flash tube is so high that electricity stored in the main capacitor is kept from being discharged. In synchronism with an opening movement of a shutter of the camera, the trigger capacitor discharges. A current of electricity is discharged at a high voltage, which ionizes the xenon gas so as to reduce the resistance between the anode and cathode. In response to the reduction of the resistance, the electricity stored in the main capacitor is discharged in the flash tube to cause the flash device to emit a flash of light.

The cathode to be incorporated in the flash tube must be able to emit a great number of electrons instantaneously within the flash tube. It is conventional to include cesium (Cs) in the cathode, because cesium promotes electron emission. To include cesium in the cathode, there is a conventional method in which a cesium coating is applied on the cathode. According to this known method, a cesium compound such as cesium carbonate or cesium oxalate is dissolved in water or alcohol. A base metal material, e.g. nickel (Ni), for the cathode is immersed in the cesium compound solution, in order to coat the base metal material with the cesium compound.

A problem of the cesium coating method lies in the great number of steps for manufacturing, and in complicated operation. The cesium compound solution must be prepared. The immersion of the base metal into the solution must be associated with subsequent processes, such as drying process or a surface activating process, for finishing the cathode. It is difficult to keep the quality of successively manufactured cathodes stably constant, because differences between the numerous cathodes are great regarding performance, such as differences in longevity of the flash tube incorporating each cathode, and differences in the minimum voltage for flash emission of the flash tube. It is also difficult to keep regular the proportions of compounds, including the cesium compound. If too little cesium compound is included in the cathode, the resulting flash tube emits an insufficient flash. If too much cesium compound is included, the resulting flash tube will not have a long life.

OBJECT OF THE INVENTION

In view of the foregoing problems, an object of the present invention is to provide an electronic flash tube, a cathode for the flash tube, capable of being manufactured with ease and with consistently high quality.

SUMMARY OF THE INVENTION

In order to achieve the above and other objects and advantages of this invention, a cathode, for use in an electronic flash tube, includes at least a first material of metal and a second material having a characteristic of readily emitting electrons. The second material is a compound including cesium and a metallic element which is selected from the group consisting of tantalum, zirconium, tungsten, titanium, vanadium, niobium and molybdenum. The second material comprises less than 40% by weight of the whole.

In a method for producing the second material, powder is used, of a compound including cesium and a metal element which is selected from the group consisting of tantalum, zirconium, tungsten, titanium, vanadium, niobium and molybdenum. The second material is mixed with powder of the first material. The mixture of the first and second materials is then molded. The molded mixture is then sintered.

In a preferred embodiment, a lens-fitted photo film unit has a main body and a flash device disposed in front of the main body and provided with the electronic flash tube. Rare gas is enclosed in the flash tube. An anode is disposed inside the flash tube and has an end fixed on the flash tube. The cathode is disposed inside the flash tube, provided with an end fixed on the body, and projects toward the anode.

The electronic flash tube, and the cathode for the flash tube can be manufactured with ease and with consistently high quality. The number of steps for manufacturing the cathode and the flash tube can be decreased. No processes subsequent to the step of mounting the electron emitting member are required.

The quality of successively manufactured cathodes can be easily kept stably constant. No matter how numerous the cathodes that are produced, there are only small differences in the useful life of the flash tube incorporating each cathode, and only small differences in the minimum or threshold voltage for flash emission of the flash tube.

The proportion of the included cesium compound can be easily kept constant. There arises no problem of an insufficient flash, or too short a shelf life of the flash tube.

BRIEF DESCRIPTION OF THE DRAWINGS

The above and other objects and advantages of the present invention will become more apparent from the following detailed description when read in connection with the accompanying drawings, in which.

DETAILED DESCRIPTION OF THE PREFERRED EMBODIMENTS

Figure 1:
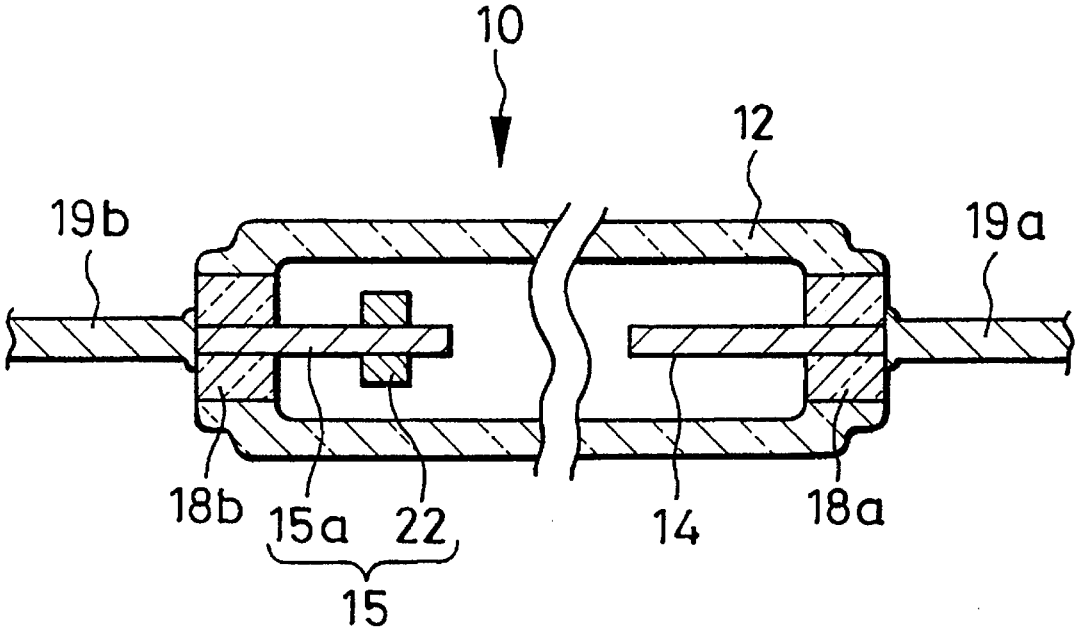
FIG. 1 is a horizontal section, partly broken away, illustrating a xenon flash,tube according to the present invention.

FIG. 1 illustrates a xenon flash tube 10, which is constituted by a transparent glass tubular body 12, an anode 14 and a cathode 15. The anode 14 consists of a tungsten anode pin, supported in a glass bead **18*a* and projecting into the tube body 12. A nickel pin 19*a* as an external terminal is welded on an outer end of the glass bead 18*a* in contact with the anode 14**.

The cathode 15 is constituted by a tungsten cathode pin 15*a* and an electron emitting member 22 fixed thereon. The cathode pin 15*a* is supported in a glass bead 18*b* and projects into the tubular body 12. A nickel pin 19*b* as an external terminal is welded on an outer end of the glass bead 18*b* in contact with the cathode pin 15*a*. The tubular body 12 is filled with xenon gas (Xe). Base portions of the anode 14 and the cathode 15 are tightly fitted on the tubular body 12 via the glass beads 18*a* and 18*b*, so that the xenon gas is sealed inside the xenon flash tube 10.

Figure 2:
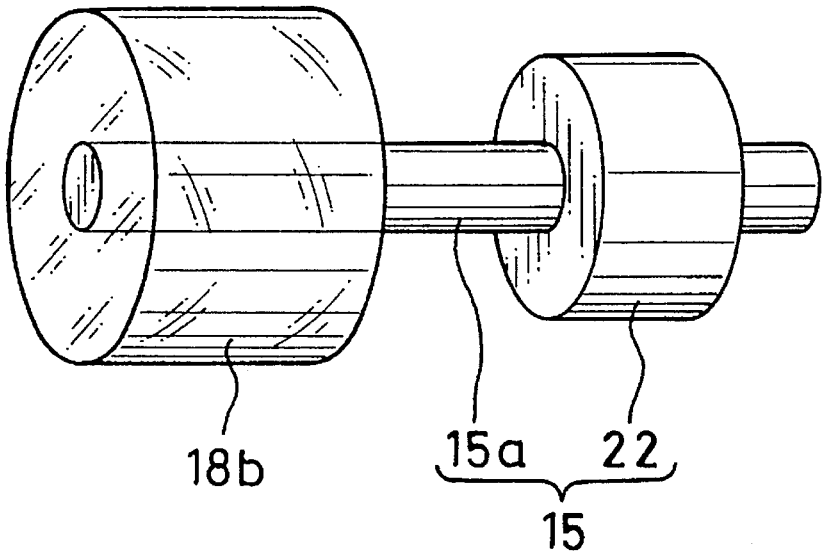
FIG. 2 is a perspective view illustrating a cathode incorporated in the flash tube of FIG. 1.
Figure 3:
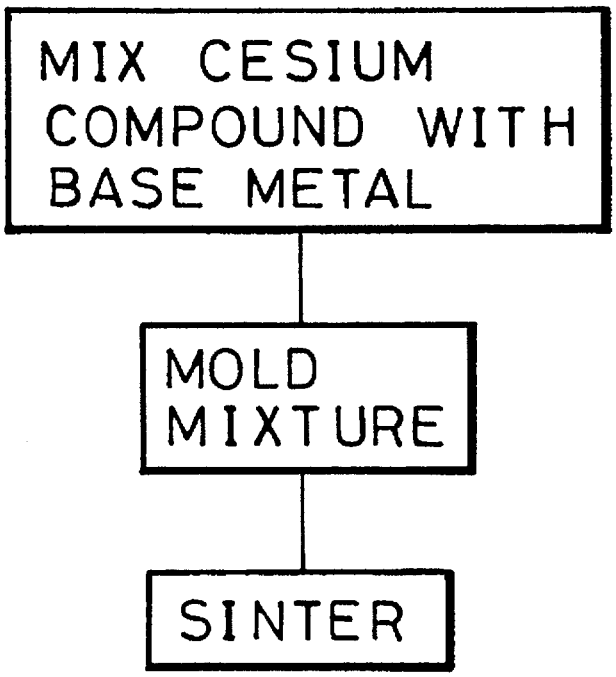
FIG. 3 flow chart illustrating a method of producing the flash tube.

The electron emitting member 22 is shaped like a doughnut as illustrated in FIG. 2, and formed from base metal material with electron emitting material added thereto. The base metal material is nickel (Ni) and tantalum (Ta), both powdered. The electron emitting material is powdered cesium tantalate ($Cs_2Ta_2O_6$). As is illustrated in the flow chart of FIG. 3, the cesium tantalate is mixed with the nickel and tantalum, to which a binder is added in a proper amount. The mixture is a uniform mixture, which is molded, and then sintered in a vacuum at a temperature of 800° C. The cathode pin 15*a* is subsequently inserted into the sintered electron emitting member 22.

Experiments were conducted. Samples of the electron emitting member 22 were produced while changing the proportion of mixing the base metal material and the electron emitting material, as in Table 1:

TABLE 1

| | | Powdered Material (wt. %) | | |
|---|---|---|---|---|
| | | | Base Metal Material | |
| | | $Cs_2Ta_2O_6$ | Ni | Ta |
| Samples | 1 | 10 | 70 | 20 |
| | 2 | 25 | 58 | 17 |
| Comparable Example | | 40 | 47 | 13 |

The Comparable Example resulted in failure in molding, because moldability after mixing the powdered materials was low due to low fluidity of the powder mixture. It follows that the proportion of the cesium tantalate to be included is preferably less than 40 wt. %.

Each of Samples 1 and 2 was assembled into a tubular body 12 which had a length of 24 mm and an external diameter of 3.15 mm. Xenon gas was enclosed in the tubular body 12 at a pressure of 600 Torr (800 hPa), to obtain the xenon flash tube 10. The xenon flash tube 10 was experimentally actuated 1,000 times, while observing the voltage applied to the xenon flash tube 10 to check the minimum sufficient for actuation. The results of the experiments are shown in Table 2 below:

TABLE 2

| | Samples | | Comparable |
|---|---|---|---|
| | 1 | 2 | Example |
| Ratio of $Cs_2Ta_2O_6$ (wt. %) | 10 | 25 | 40 |
| Moldability | Good | Good | Failure |
| Minimum Voltage (in V) for Flash Emission | 180 | 180 | — |
| Successful Flash Emission at 1,000 Times | Yes | Yes | — |

It follows from Table 2 that cesium tantalate is preferable as the electron emitting material included in the electron emitting member 22 of the cathode 15 in the xenon flash tube 10. Slight changes in the amount of cesium tantalate do not affect the successful performance of flash emission by the xenon flash tube 10. It is possible to make small changes in the amount of cesium tantalate while still achieving the aims of the invention. But if the proportion of the cesium tantalate is 40 wt. % or more, there will be failure in molding an electron emitting member inclusive of it, because the moldability after mixing the materials will be low, and the resulting molded compact cannot be sintered.

Instead of cesium tantalate, it is also possible to use other cesium compounds for the electron emitting material in the electron emitting member 22 of the cathode 15. Preferred compounds are cesium zirconate, cesium tungstate, cesium titanate, cesium vanadate, cesium niobate, and cesium molybdate, in the powdered state. One or more compounds are selected, and mixed with the nickel and tantalum, to which a binder agent is added in a proper amount. The mixture is agitated to a uniform mixture, molded, and sintered in a vacuum at a temperature of 900° C.

Experiments were conducted. Samples 3 to 13 of the electron emitting member 22 were produced while changing the proportion of mixing the base metal material and the electron emitting material, as in Table 3. Among the samples, Samples 3 to 8 included a respective single cesium compound. Samples 9 to 11 included respectively two cesium compounds. Samples 12 and 13 included a single cesium compound but in increased proportions.

TABLE 3

| | Powdered Material (wt. %) | | |
|---|---|---|---|
| | | Base Metal Material | |
| Samples | Cesium Compounds | Ni | Ta |
| 3 | Zirconate, 15 | 65 | 20 |
| 4 | Tungstate, 15 | | |
| 5 | Titanate, 15 | | |
| 6 | Vanadate, 15 | | |
| 7 | Niobate, 15 | | |
| 8 | Molybdate, 15 | | |
| 9 | Niobate, 10; Zirconate, 5 | | |
| 10 | Tungstate, 10; Molybdate, 5 | | |
| 11 | Vanadate, 10; Titanate, 5 | | |
| 12 | Zirconate, 25 | 60 | 15 |
| 13 | Zirconate, 20 | 63 | 17 |

Each of Samples 3 to 13 was assembled into a tubular body 12 filled with xenon gas, under the same conditions as former Samples 1 and 2, to obtain xenon flash tubes 10. The xenon flash tubes 10 were experimentally actuated 1,000 times. An evaluation of the results of the experiments is shown in Table 4 below:

TABLE 4

| Samples | Minimum Voltage (in V for Flash Emission | Successful Flash Emission at 1,000 Times |
|---|---|---|
| 3 | 180 | Yes |
| 4 | 170 | Yes |
| 5 | 180 | Yes |
| 6 | 190 | Yes |
| 7 | 180 | Yes |
| 8 | 180 | Yes |
| 9 | 180 | Yes |
| 10 | 180 | Yes |
| 11 | 180 | Yes |

TABLE 4-continued

| Samples | Minimum Voltage (in V for Flash Emission | Successful Flash Emission at 1,000 Times |
|---|---|---|
| 12 | 190 | Yes |
| 13 | 180 | Yes |

It follows from Table 4 that those six cesium compounds are suitable as electron emitting materials included in the electron emitting member 22. Not only the inclusion of one of those cesium compounds, but also the inclusion of a plurality of those, is possible. Slight changes in the amounts of the cesium compounds do not affect the successful performance of flash emission by the xenon flash tube 10. It is possible to make small changes in the amount of cesium compounds while still achieving the aims of the invention.

Figure 4:
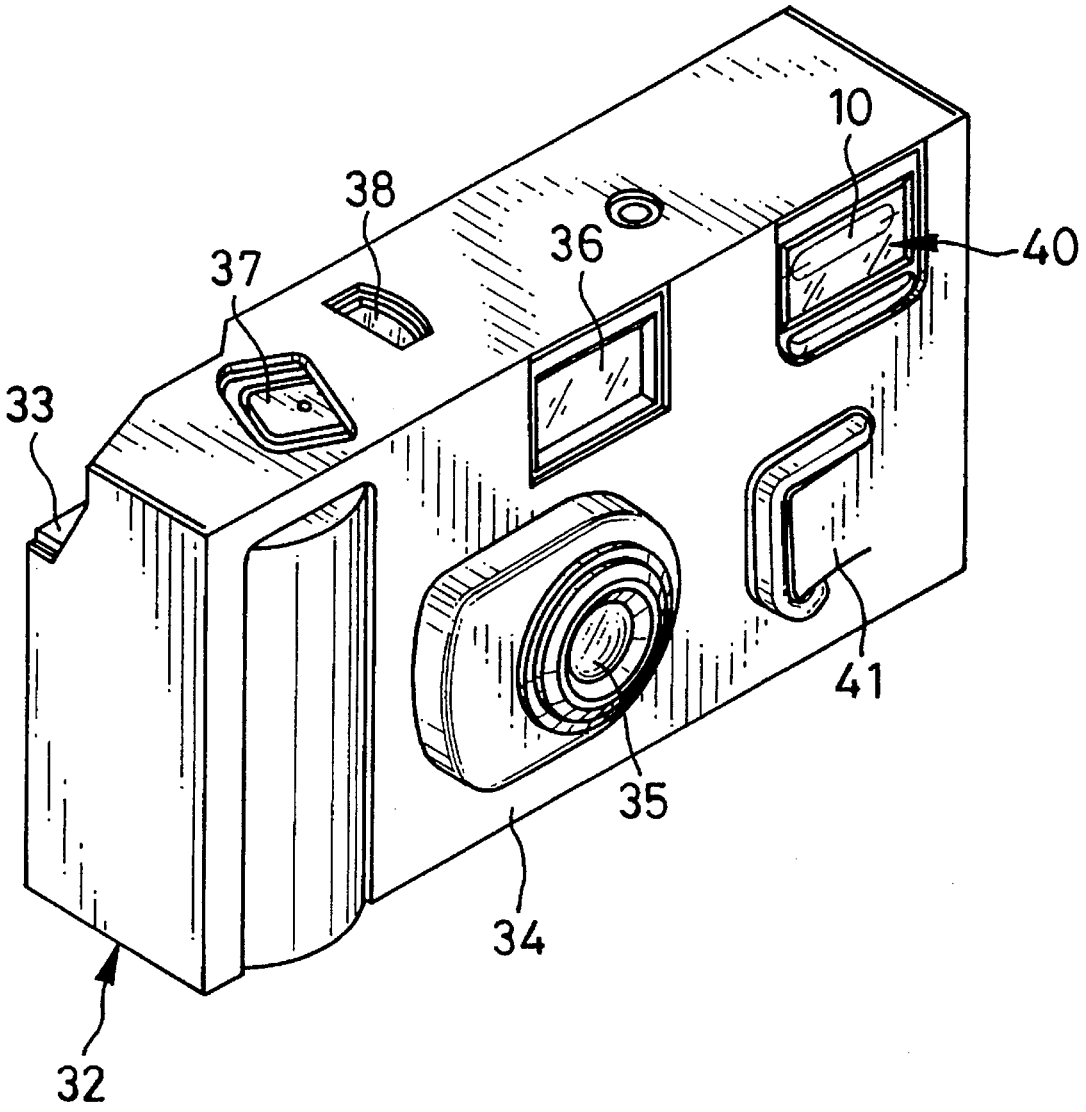
FIG. 4 is a perspective view illustrating a lens-fitted photo film unit incorporating the flash tube.

It is convenient to use the xenon flash tube 10 in a single-use camera or lens-fitted photo film unit 32 as illustrated in FIG. 4. A photo film housing 33 is formed from plastics, and generally packaged in an outer case or cardboard packaging 34. The packaging 34 is adapted to preserve and to impart a neat appearance to the photo film unit 32, and is provided with printed information and decoration thereon. For photography, the packaging 34 has openings or holes uncovering a taking lens 35, a viewfinder window 36, a shutter button 37, a frame number indicator window 38, and a photo film winding wheel (not shown), and a flash emitting section 40. If photography with flash emission is desired, a switch button portion 41 is depressed before or during operation of the shutter button 37.

The flash device is unified as a single device, which is constituted of relevant circuit elements, the flash emitting section 40 incorporating the xenon flash tube 10, a synchro switch, a pair of battery terminal plates, and a main capacitor behind the flash emitting section 40, all together on a printed circuit board. During photography with operation of the flash device, the depression of the switch portion 41 causes a metal contact segment to come in contact with, and interconnect, two terminals, which stores electrical charge in a main capacitor. The charge stored in the capacitor, in response to a releasing operation of a shutter device associated with the shutter button 37, is caused to discharge in the xenon flash tube 10 in the flash emitting section 40, through the synchro switch.

In the above embodiment, the base metal material of the electron emitting member 22 is nickel and tantalum to be mixed as alloy. Alternatively metals other than those are usable as the base metal material of an electron emitting member according to the present invention.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as being included therein.

What is claimed is:

1. A cathode for use in an electronic flash tube, said cathode consisting essentially of a sintered uniform mixture of at least a first material of metal and a second material, wherein:

said second material is a compound including cesium and at least one metal element which is selected from the group consisting of tantalum, zirconium, tungsten, titanium, vanadium, niobium and molybdenum.

2. A cathode as defined in claim 1, wherein said second material is present in a proportion from about 10% to less than 40% by weight of the whole.

3. A cathode as defined in claim 1, wherein said second material is a mixture of at least two members selected from said cesium compounds.

4. A cathode as defined in claim 1, wherein said first and second materials are mixed in a powdered state.

5. A cathode as defined in claim 4, wherein the mixture of said first and second materials is molded and subsequently sintered.

6. A cathode as defined in claim 1, which comprises a metallic cathode pin, and an electron emitting member mounted on said cathode pin and formed from said first and second materials.

7. A cathode as defined in claim 6, wherein said electron emitting member is shaped like a doughnut, into which said cathode pin is inserted.

8. A cathode as defined in claim 1, wherein said first material is at least one member selected from the group consisting of nickel and tantalum.

9. A cathode as defined in claim 1, wherein binder is added to said first and second materials.

10. A cathode as defined in claim 6, wherein said cathode pin is of tungsten.

11. A cathode as defined in claim 1, wherein said second material is at least one compound selected from the group consisting of cesium tantalate, cesium zirconate, cesium tungstate, cesium titanate, cesium vanadate, cesium niobate and cesium molybdate.

12. An electronic flash tube comprising:

a transparent body;

rare gas enclosed in said body;

an anode disposed inside said body and provided with an end fixed on said body; and a cathode disposed inside said body, provided with an end fixed on said body, said cathode projecting toward said anode, said cathode consisting essentially of a sintered uniform mixture of at least a first material of metal and a second material which has the property of readily emitting electrons and is of at least one member selected from the group consisting of cesium tantalate, cesium zirconate, cesium tungstate, cesium titanate, cesium vanadate, cesium niobate and cesium molybdate.

13. An electronic flash tube as defined in claim 12, wherein said first and second materials are mixed in a powdered state, molded and subsequently sintered.

14. An electronic flash tube as defined in claim 12, wherein said cathode includes a metallic cathode pin, and an electron emitting member mounted on said cathode pin and formed from said first and second materials.

15. An electronic flash tube as defined in claim 14, wherein said electron emitting member is shaped like a doughnut, into which said cathode pin is inserted.

* * * * *